US005266082A

United States Patent [19]

Sanders

[11] Patent Number: 5,266,082

[45] Date of Patent: Nov. 30, 1993

[54] FUEL ADDITIVE

[76] Inventor: James K. Sanders, 9608 Toledo, Lubbock, Tex. 79424

[21] Appl. No.: 869,771

[22] Filed: Apr. 16, 1992

[51] Int. Cl.[5] ..... C10L 1/12; C10L 1/18

[52] U.S. Cl. ..... 44/357; 44/354; 44/445; 44/452

[58] Field of Search ..... 44/354, 357, 445, 452

[56] References Cited

U.S. PATENT DOCUMENTS

| | | | |
|---|---|---|---|
| 1,496,260 | 6/1924 | Ferrer | 44/438 |
| 2,088,000 | 7/1937 | Savage | 44/438 |
| 2,726,942 | 12/1955 | Arkis et al. | 44/452 |
| 2,781,005 | 2/1957 | Taylor et al. | 44/357 |
| 3,348,932 | 10/1967 | Kukin | 44/321 |
| 3,925,031 | 12/1975 | Villacampa | 44/437 |
| 4,180,385 | 12/1979 | Chikul et al. | 44/354 |
| 4,392,868 | 7/1983 | Teckmeyer et al. | 44/452 |
| 4,518,395 | 5/1985 | Petronella | 44/445 |
| 4,806,129 | 2/1989 | Dorn et al. | 44/411 |

FOREIGN PATENT DOCUMENTS

| | | | |
|---|---|---|---|
| 215062 | 6/1956 | Australia | 44/445 |
| 759826 | 10/1956 | United Kingdom | 44/357 |
| 2109404 | 6/1983 | United Kingdom | 44/357 |

*Primary Examiner*—Ellen M. McAvoy
*Attorney, Agent, or Firm*—Hubbard, Thurman, Tucker & Harris

[57] ABSTRACT

Fuel additive compositions for improving the combustion efficiency of an internal combustion engine, and thereby substantially reducing undesirable motor vehicle exhaust emissions as well as fuel consumption. The composition is composed of a bicyclic aromatic component selected from the group consisting of naphthalene, substituted naphthalene, biphenyl, biphenyl derivatives, and mixtures thereof, zinc oxide, and at least one Group 8-11 metal oxide selected from the group consisting of iron oxide, copper oxide, cobalt oxide, ruthenium oxide, osmium oxide, and palladium oxide, all dispersed in a carrier liquid selected from the group consisting of a hydrocarbon fraction in the kerosine boiling range having a flash point of at least 100° F. and an auto-ignition temperature of at least 400° F., a $C_{1-C3}$ monohydric, dihydric or polyhydric aliphatic alcohol, and mixtures thereof. In a preferred embodiment the composition also contains magnesium oxide. In an alternate embodiment, the composition contains a mixture of magnesium oxide, zinc oxide and iron oxide, all dispersed in the carrier liquid. The present invention is also directed to processes for formulating a fuel blend for use in fueling an internal combustion engine as well as processes for operating an internal combustion engine with both an associated fuel chamber from which fuel is supplied to the engine and an exhaust system for the emission of combustion products from the engine.

49 Claims, No Drawings

FUEL ADDITIVE

TECHNICAL FIELD

The present invention is directed toward fuel additive compositions and processes involving their use in internal combustion engines and, more specifically, the employment of such compositions or processes to effectively reduce undesirable motor vehicle exhaust emissions and/or decrease fuel consumption.

BACKGROUND OF THE INVENTION

Exhaust emissions from internal combustion engines present serious environmental concerns. Motor vehicle exhaust emissions, in particular, present a serious, unchecked problem in many large cities. The emissions not only contribute to the smog and pollution problems of many large metropolitan areas, resulting in the silent, continual destruction of the ozone layer, but may also cause long term health effects due to their potential toxicity. In an attempt to regulate the levels of potentially harmful pollutants in the environment, the Environmental Protection Agency promulgated new emissions standards, setting forth acceptable levels of carbon monoxide, nitrogen oxides, particulate matter and hydrocarbons in the exhaust emissions of various classes of motor vehicles. The new standards will be implemented in phases, beginning with the 1994 model year.

The hydrocarbon content of vehicle emissions is indicative of the fuel burning efficiency of the engine. The higher the percentage of hydrocarbon (HC) emissions, the lower the level of hydrocarbons efficiently burned. The carbon dioxide ($CO_2$) content of the emissions reflects the combustion efficiency and catalytic action of the engine and fuel components. The higher the carbon dioxide content, the more efficient the combustive process. The carbon monoxide (CO) content of the emissions is indicative of the level of combustion in the engine chamber. A high percentage of carbon monoxide in motor vehicle emissions, often caused by a lean air to fuel ratio, is indicative of incomplete combustion in the engine chamber. A high molecular oxygen ($O_2$) content in the emissions could mean a lean fuel to air ratio or fouled plugs. Ideally, motor vehicle exhaust emissions contain low percentages of hydrocarbons, carbon monoxide and molecular oxygen, and a high percentage of carbon dioxide.

The use of a fuel additive in an internal combustion engine to improve combustion is well-known in the art. For example, it is known in the art that a fuel additive containing various metals may reduce soot build-up on an internal combustion engine and thereby improve combustion. Kukin U.S. Pat. No. 3,348,932, for example, discloses a fuel additive containing combinations of various metals designed to effectively reduce soot build-up.

It is also known in the art that organic aromatic and aliphatic components used in concert may increase the power of the fuel. For example, one early fuel additive described in Ferrer U.S. Pat. No. 1,496,260, used a combination of acetone ($C_3H_6O$), camphor ($C_{10}H_{16}O$), naphthalene ($C_{10}H_8$), methyl alcohol ($CH_3OH$), diethyl ether $(C_2H_5)_2O$ and amyl alcohol ($C_5H_{11}OH$) both to increase the power of the fuel and to help keep the engine cylinders and pistons free from carbon.

It is also known in the art that certain combinations of organic aromatic and aliphatic components added to fuel may improve engine performance and decrease certain motor vehicle emissions. For example, Savage U.S. Pat. No. 2,088,000 describes a motor fuel additive composed of varying quantities and combinations of alcohol, naphthalene and acetone. Though use of a small amount of the Savage additive in motor fuel results in improved engine performance and a decreased percentage of carbon monoxide in exhaust emissions, Savage does not disclose a decrease in the percentage of either hydrocarbons or molecular oxygen emitted, nor does it disclose an increase in the percentage of carbon dioxide emitted.

Along the same lines, Villacampa U.S. Pat. No. 3,925,031 is directed toward a fuel additive consisting of various organic components including naphthalene, camphor, toluene and benzyl alcohol, as well a gasoline fraction. A small weight percentage of a $C_1$–$C_8$ alkyl alcohol may also be included in the Villicampa composition. Use of the Villacampa additive results in increased horsepower of the internal combustion engine utilizing the fuel, a reduction in the fuel oil consumption rate, and reductions in hydrocarbon output, carbon monoxide output and nitrous oxide production. Though the Villacampa patent discloses a potential 46% decrease in hydrocarbon emissions and a potential 55% decrease in carbon monoxide emissions through use of the Villacampa additive, neither an decrease in molecular oxygen output nor increase in carbon dioxide in the emissions is disclosed.

Dorn et al. U.S. Pat. No. 4,806,129 is directed toward an oxygenated fuel extender comprised of naphtha, anhydrous ethanol, water repellants of the class consisting of ethyl acetate and methyl isobutyl ketone, and various aromatic compounds such as benzene, toluene and xylene. The purpose of the Dorn et al. extender is to serve as a fuel substitute, resulting in a decreased amount of actual fuel usage and, hence, a lower fuel cost. Dorn et al. does not disclose decreased emissions as an object of the extender.

Chikul et al. U.S. Pat. No. 4,180,385 describes a fuel composition containing a high-boiling petroleum fuel and an additive that includes, as a principal ingredient, an ash-containing resin derived from the thermal processing of a solid fuel. Though Chikul, like the present invention, does contemplate the inclusion of metal oxides such as magnesium oxide and iron oxide in the composition, it does not disclose inclusion of any organic components such as those contemplated by the present invention. Furthermore, though Chikul states as an objective the reduced pollution of the environment resulting from the combustion of the fuel composition, no reduced emissions statistics are disclosed. Instead, the patent focuses on the production of the ash-containing resin and its anti-corrosive effects.

BRIEF SUMMARY OF THE INVENTION

The present invention is directed to fuel additive compositions and processes for improving combustion and substantially reducing hydrocarbon (HC), carbon monoxide (CO), and molecular oxygen ($O_2$) motor vehicle exhaust emissions. The fuel additive composition comprises (1) at least 90% of a carrier liquid selected from the group consisting of a hydrocarbon fraction in the kerosene boiling range having a flash point of at least 100° F. and an auto-ignition temperature of at least 400° F., a $C_1$–$C_3$ monohydric, dihydric or polyhydric aliphatic alcohol, and mixtures thereof, (2) a bicyclic aromatic component selected from the group consisting of naphthalene, substituted naphthalene, biphenyl, biphenyl derivatives, and mixtures thereof, (3) zinc oxide, and (4) at least one Group 8–11 metal oxide selected from the group consisting of iron oxide, copper oxide, cobalt oxide, ruthenium oxide, osmium oxide, and palladium oxide, present in an amount less than the amount of zinc oxide. In a preferred embodiment the composition also contains magnesium oxide in an amount less than the amount of zinc oxide. Preferably, the magnesium oxide and Group 8–11 metal oxide components are present in a composite amount which is less than the bicyclic aromatic component. The weight ratio of the bicyclic aromatic component to zinc oxide is preferably within the range of about 4:3 to about 1:3. More preferably, the ratio is about 5:4.

Preferably, the bicyclic aromatic component of the present invention is naphthalene, the Group 8–11 metal oxide is iron oxide, and the weight ratio of the composite of zinc oxide and naphthalene to the composite of iron oxide and magnesium oxide is at least about 3:1. More preferably, the bicyclic aromatic component is naphthalene, the Group 8–11 metal oxide is iron oxide, and the weight ratio of the composite of zinc oxide and naphthalene to the composite of iron oxide and magnesium oxide is about 30:1.

As noted above, the bicyclic aromatic and inorganic metal oxide components of the invention are dispersed in a solution comprising at least 90% by weight of a carrier liquid selected from the group consisting of a hydrocarbon fraction in the kerosene boiling range having a flash point of at least 100 degrees F., a $C_1$–$C_3$ monohydric, dihydric or polyhydric aliphatic alcohol, and mixtures thereof. Preferably, the carrier liquid is comprised at least 80% by weight of an aliphatic alcohol selected from the group consisting of methanol, ethanol or isopropyl alcohol, and no more than 20% by weight of kerosene. More preferably, the carrier liquid is comprised of at least 80 wt. % methanol and from about 5 wt. % to about 20 wt. % kerosene.

In an alternate embodiment of the invention, the fuel additive composition is comprised at least 90% by weight of a carrier liquid selected from the group consisting of a hydrocarbon fraction in the kerosene boiling range having a flash point of at least 100° F. and an auto-ignition temperature of at least 400° F., a $C_1$–$C_3$ monohydric, dihydric or polyhydric alcohol, and mixtures thereof, and no more than 10% by weight of a mixture of magnesium oxide, iron oxide and zinc oxide in weight ratios of about 1:1:1.

The present invention is also directed to processes for formulating a fuel blend for use in an internal combustion engine comprising providing a hydrocarbon-containing fuel for the internal combustion engine and adding to that hydrocarbon-containing fuel a fuel extending additive comprised of (1) a bicyclic aromatic component selected from the group consisting of naphthalene, substituted naphthalene, biphenyl, biphenyl derivatives, and mixtures thereof, (2) zinc oxide, and (3) at least one Group 8–11 metal oxide selected from the group consisting of iron oxide, copper oxide, cobalt oxide, ruthenium oxide, osmium oxide, and palladium oxide, present in an amount less than the amount of zinc oxide. In a preferred embodiment the composition also contains magnesium oxide in an amount less than the amount of zinc oxide. Preferably, the additive is added to the hydrocarbon fuel in an amount sufficient to provide a decrease of at least 50% each in hydrocarbon and carbon monoxide emissions from the exhaust system of the internal combustion engine, when compared with the corresponding emissions from the exhaust system without the inclusion of the additive. More preferably, the additive is added to the hydrocarbon fuel in an amount sufficient to provide a decrease in emissions from the exhaust system of at least 50% each in hydrocarbon and carbon monoxide emissions and at least a 10% decrease in molecular oxygen emissions when compared with the corresponding emissions from the exhaust system without the inclusion of the additive. In an alternate embodiment, the additive is added to the hydrocarbon-containing fuel in an amount sufficient to provide a decrease of at least 10% in the amount of the hydrocarbon-containing fuel consumed by the internal combustion engine as compared to the amount of the hydrocarbon-containing fuel consumed by the engine when the additive is not used.

The present invention is also directed toward a process used in the operation of an internal combustion engine having both an associated fuel chamber from which fuel is supplied to the engine and an exhaust system for the emission of combustion products from the engine. The process comprises providing in the fuel chamber a hydrocarbon-containing fuel suitable for use in the internal combustion engine and providing in the fuel chamber a fuel extending additive in a mixture with the hydrocarbon-containing fuel, where the fuel extending additive is comprised of a mixture of magnesium oxide, zinc oxide and iron oxide in relative amounts to provide a decrease in emissions from the exhaust system of the internal combustion engine of at least 50% in hydrocarbon emissions, at least 50% in carbon monoxide emissions and at least 10% in molecular oxygen emissions as compared to the corresponding emissions from the exhaust system when the hydrocarbon-containing fuel is used without the inclusion of the fuel extending additive. In an alternative embodiment, the fuel extending additive is comprised of a mixture of magnesium oxide, zinc oxide and iron oxide in relative amounts to provide a decrease of at least 10% in the amount of the hydrocarbon-containing fuel consumed by the internal combustion engine as compared to the corresponding amount of the hydrocarbon-containing fuel consumed by the engine when the additive is not included.

The hydrocarbon-containing fuel and fuel extending additive can be supplied to the fuel chamber either separately or together as a mixture. The fuel additive composition may also include a bicyclic aromatic component selected from the group consisting of naphthalene, substituted naphthalene, biphenyl, biphenyl derivatives, and mixtures thereof. If the additive does contain such a bicyclic aromatic component, the weight ratio of the composite of the bicyclic aromatic component and the zinc oxide component to the composite of iron oxide and magnesium oxide is at least about 3:1 and, more preferably, is about 30:1.

Alternatively, the metal oxides may be supplied to the fuel chamber in a carrier liquid selected from the group consisting of a hydrocarbon fraction in the kerosene boiling range, a $C_1$–$C_3$ monohydric, dihydric or polyhydric aliphatic alcohol, and mixtures thereof. In addition to the metal oxides, the composition in the carrier liquid may also contain a bicyclic aromatic component selected from the group consisting of naphthalene, substituted naphthalene, biphenyl, biphenyl derivatives, and mixtures thereof. Preferably, the weight ratio of the composite of the bicyclic aromatic component and the zinc oxide component to the composite of the iron oxide and magnesium oxide is at least about 3:1.

DETAILED DESCRIPTION OF PREFERRED EMBODIMENTS

The present invention is directed to fuel additive compositions and processes for improving combustion in an internal combustion engine and substantially reducing potentially hazardous exhaust emissions. This invention is particularly adapted for reducing the percentages of hydrocarbons, carbon monoxide and molecular oxygen in motor vehicle exhaust emissions. Use of the fuel additive composition may also result in a desirable increase in the percentage of carbon dioxide in motor vehicle exhaust emissions.

The fuel additive composition of the present invention is formulated by combining a variety of inorganic metal oxides and organic components. With respect to the inorganic metal oxides, the composition contains particular weight ratios of zinc oxide, at least one Group 8-11 metal oxide selected from the group consisting of iron oxide, copper oxide, cobalt oxide, ruthenium oxide, osmium oxide and palladium oxide, and, in a preferred embodiment, magnesium oxide. Though the Group 8-11 metal oxide may be selected from the group of Group 8-11 metal oxides listed above, as a practical matter iron oxide is preferable due to its relatively low cost and high rate of effectiveness. As will be recognized by one skilled in the art, the "Group 8-11" designation reflects the new notation used in the Periodic Table of the Elements.

With respect to the organic components, the composition contains a bicyclic aromatic component selected from the group consisting of naphthalene, substituted naphthalene, biphenyl, biphenyl derivatives, and mixtures thereof. The magnesium oxide and Group 8-11 metal oxide components are preferably present in a composite amount which is less than the amount of the bicyclic aromatic component. Preferably, the bicyclic aromatic component is naphthalene.

Likely, the bicyclic aromatic components and metal oxides work together to reduce exhaust emissions by way of an oxygen transport mechanism. Zinc oxide and magnesium oxide probably serve as heterogeneous catalysts which adhere tightly to the metal surfaces inside the internal combustion engine and thereby provide a surface to which hydrocarbon molecules may attach, while the Group 8-11 metal oxide likely functions in an oxidation-reduction capacity. The bicyclic aromatic component is an electron rich reducing agent that likely activates the zinc oxide and magnesium oxide catalysts by reducing the Group 8-11 metal oxide. Subsequent to the oxidation-reduction reaction, oxygen is transferred from an oxide to carbon and replaced with oxygen from the air. Ideally, the result is a decrease in hydrocarbon emissions, carbon monoxide and oxygen emissions. A desirable increase in carbon dioxide emissions may also result.

To maintain the efficacy of the composition, the metal oxides and bicyclic aromatic components must be present in particular weight ratios. For example, the weight ratio of the bicyclic aromatic component to zinc oxide is preferably within the range of about 4:3 to about 1:3, and, more preferably, is about 5:4. In a preferred embodiment, the bicyclic aromatic component is naphthalene, the Group 8-11 metal oxide is iron oxide, and the weight ratio of the composite of zinc oxide and naphthalene to the composite of iron oxide and magnesium oxide preferably is at least about 3:1. More preferably, the bicyclic aromatic component is naphthalene, the Group 8-11 metal oxide is iron oxide, and the weight ratio of the composite of zinc oxide and naphthalene to the composite of iron oxide and magnesium oxide is about 30:1.

The metal oxides and bicyclic aromatic compound(s) in the composition of the present invention are dispersed in a carrier liquid, such that the composition is comprised at least 90% by weight of a carrier liquid selected from the group consisting of a hydrocarbon fraction in the kerosine boiling range having a flash point of at least 100° F. and an auto-ignition temperature of at least 400° F., a $C_1$–$C_3$ monohydric, dihydric or polyhydric aliphatic alcohol, and mixtures thereof. The hydrocarbon fraction is preferably kerosine. As one skilled in the art will recognize, the category of permissible aliphatic alcohols includes, but is not limited to, methanol, ethanol, isopropyl alcohol and ethylene glycol. Preferably, the aliphatic alcohol is selected from the group consisting of methanol, ethanol and isopropyl alcohol. As a practical matter, methanol is more preferable due to its relatively high flash point and the increased solubility of the metal components that is achieved with its use.

Though either a hydrocarbon fraction or a monohydric, dihydric or polyhydric aliphatic alcohol may alone comprise 100% by weight of the carrier liquid, the carrier liquid is preferably comprised at least 80% by weight of an aliphatic alcohol selected from the group consisting of methanol, ethanol or isopropyl alcohol, and no more than 20% by weight of kerosene. More preferably, the carrier liquid is comprised at least 80% by weight of methanol and from about 5 wt. % to about 20 wt. % of kerosene.

Some fuel additives incorporate large quantities of ketones, such as acetone, or ethers. Ferrer U.S. Pat. No. 1,496,260, for example, discloses a fuel additive composition that contains a large quantity of acetone. A large quantity of a ketone or ether is not necessary in the present invention and, moreover, preferably is not present because ketones and ethers may decrease the solubility of the metal components and undesirably reduce the flash point of the composition.

In an alternate embodiment of the invention, the fuel additive composition is comprised at least 90% by weight of a carrier liquid selected from the group consisting of a hydrocarbon fraction in the kerosene boiling range having a flash point of at least 100° F. and an auto-ignition temperature of at least 400° F., a $C_1$–$C_3$ monohydric, dihydric or polyhydric alcohol, and mixtures thereof, and no more than 10% by weight of a mixture of magnesium oxide, iron oxide and zinc oxide in weight ratios of about 1:1:1.

The present invention is also directed to processes for formulating a fuel blend for use in an internal combustion engine comprising providing a hydrocarbon-containing fuel for the internal combustion engine and adding to that hydrocarbon-containing fuel a fuel extending additive comprised of (1) a bicyclic aromatic component selected from the group consisting of naphthalene, substituted naphthalene, biphenyl, biphenyl derivatives, and mixtures thereof, (2) zinc oxide, and (3) at least one Group 8-11 metal oxide selected from the group consisting of iron oxide, copper oxide, cobalt oxide, ruthenium oxide, osmium oxide, and palladium oxide, present in an amount less than the amount of zinc oxide. In a preferred embodiment the composition also contains magnesium oxide in an amount less than the amount of zinc oxide. Preferably, the additive is added to the hydrocarbon-containing fuel in an amount sufficient to provide decrease of at least 50% each in hydrocarbon and carbon dioxide emissions from the exhaust system as compared to the corresponding emissions from use of the hydrocarbon fuel without inclusion of the additive, has been observed. More preferably, the additive is added to the hydrocarbon-containing fuel in an amount sufficient to provide a decrease in emissions from the exhaust system of at least 50% in hydrocarbon emissions, at least 50% in carbon monoxide emissions and at least 10% in molecular oxygen emissions as compared to the corresponding emissions from the exhaust system without the inclusion of the additive. In an alternative embodiment, the additive is added to the hydrocarbon-containing fuel in an amount sufficient to provide a decrease of at least 10% in the amount of the hydrocarbon-containing fuel consumed by the internal combustion engine when compared with the corresponding amount of the hydrocarbon-containing fuel consumed by the engine when the additive is not included.

Preferably, the additive composition is used with the hydrocarbon-containing fuel in a ratio of fuel to additive of at least about 300:1. After a period of about two weeks, the ratio is preferably increased to at least about 600:1. Though the fuel additive of the present invention can be effectively used in both fuel-injected and non fuel-injected engines, as a practical matter, much faster improvement in combustion efficiency has been observed in vehicles with fuel injected systems.

The present invention can also be used in the operation of an internal combustion engine having both an associated fuel chamber from which fuel is supplied to the engine and an exhaust system for the emission of combustion products from the engine. Procedurally, the process involves providing in the fuel chamber both a hydrocarbon-containing fuel suitable for use in an internal combustion engine and a fuel extending additive in a mixture with the hydrocarbon-containing fuel, where the fuel extending additive is comprised of a mixture of magnesium oxide, zinc oxide and iron oxide in relative amounts to provide a decrease in emissions from the exhaust system of the internal combustion engine of at least 50% in hydrocarbon emissions, at least 50% in carbon monoxide emissions and at least 10% in molecular oxygen emissions as compared to the corresponding emissions from the exhaust system when the hydrocarbon-containing fuel is used without the inclusion of the fuel extending additive. In an alternative embodiment, the fuel extending additive is comprised of a mixture of magnesium oxide, zinc oxide and iron oxide in relative amounts to provide a decrease of at least 10% in the amount of the hydrocarbon-containing fuel that is consumed by the internal combustion engine as compared with the corresponding amount of the hydrocarbon-containing fuel consumed by the engine when the additive is not included.

The hydrocarbon-containing fuel and fuel extending additive can be supplied to the fuel chamber either separately or together as a mixture. The fuel additive composition may also include a bicyclic aromatic component selected from the group consisting of naphthalene, substituted naphthalene, biphenyl, biphenyl derivatives, and mixtures thereof. If the composition does contain such a bicyclic aromatic component, the weight ratio of the composite of the bicyclic aromatic component and zinc oxide to the composite of iron oxide and magnesium oxide is at least about 3:1 and, more preferably, is about 30:1.

Alternatively, the metal oxides may be supplied to the fuel chamber in a carrier liquid selected from the group consisting of a hydrocarbon fraction in the kerosene boiling range, a $C_1$–$C_3$ monohydric, dihydric or polyhydric aliphatic alcohol, and mixtures thereof. In addition to the metal oxides, the composition in the carrier liquid may further also include a bicyclic aromatic component selected from the group consisting of naphthalene, substitued naphthalene, biphenyl, biphenyl derivatives, and mixtures thereof. Preferably, the weight ratio of the composite of the bicyclic aromatic component and the zinc oxide to the composite of the iron oxide and the magnesium oxide is at least about 3:1.

It has been shown that use of the composition of the present invention in an internal combustion engine results in an increase in engine power. Additionally, it has been shown that use of the composition of the present invention in an internal combustion engine results in a visible decrease in carbon deposits on the upper cylinder of the engine.

The following examples illustrate the present invention and its various advantages in more detail.

EXAMPLE 1

A fuel additive composition was formulated by combining 4 dry ounces sodium chloride, 2 dry ounces iron oxide, and 2 dry ounces zinc oxide and then dispersing the resulting solute mixture in kerosene for a total volume of 2 gallons. The product was filtered to remove any particles not dispersed in the liquid. The filtering process could have resulted in the removal of as much as 50% of the solute. However, the solute components were presumably removed in proportional amounts.

The filtered composition was tested in numerous vehicles with moderate success in reducing hydrocarbon and carbon monoxide emission levels. The composition had a flash point above 140° F. The vehicles involved in the test were randomly selected, fuel injected and nonfuel injected, vehicles. Initially, the percentages of hydrocarbons, carbon monoxide, molecular oxygen and carbon dioxide emitted in the exhaust from each car were measured using a Sun Electric Bar-80 EPA Approved 4 Gas Analyzer. The filtered additive was then added to each vehicle in the amount of 8 total fluid ounces of the additive per 15 gallons of gasoline, and each vehicle was then driven at least 25 miles.

After driving at least 25 miles with the additive in the fuel, the percentages of hydrocarbons, carbon monoxide, molecular oxygen and carbon dioxide emitted in the exhaust from each vehicle were measured again. In some instances, emissions measurements were taken after a vehicle had been driven 25 to 50 miles with the additive. In other cases, measurements were taken after a vehicle had been driven 50 or more miles. The vehicles driven between 25 and 50 miles showed a fair reduction in undesirable emissions levels. Though the vehicles driven 50 or more miles showed good results, the results of the test as a whole were categorized as fair. Specifically, an average decrease in hydrocarbon emissions of 35% and decrease in carbon monoxide emissions of 30% was observed. No decrease in molecular oxygen emissions was observed, and an undesirable 15% average decrease in carbon dioxide emissions was reported. Accordingly, the composition of Example 1 lacked the desired efficacy.

EXAMPLE 2

This example illustrated the efficacy of a fuel additive composition comprised of 2 dry ounces sodium chloride, 4 dry ounces iron oxide and 2 dry ounces zinc oxide, dispersed in kerosene to a total volume of 2 gallons. The product was filtered to remove any particles not dispersed in the liquid. The filtering process could have resulted in the removal of as much as 50% of the solute. However, the solute components were presumably removed in proportional amounts.

Example 2 was conducted using the same protocol as Example 1 and produced virtually identical results. Those vehicles driven 25 to 50 miles with the additive showed a fair improvement in emissions reduction, and those driven 50 or more miles with the additive showed good improvement. However, the results of the test as a whole were categorized as fair. Specifically, the vehicles involved in example 2 experienced an average decrease in hydrocarbon emissions of 35% and an average decrease in carbon monoxide emissions of 30%. No decrease in molecular oxygen emissions was observed, and an undesirable 15% average decrease in carbon monoxide emissions was reported. Accordingly, the composition of Example 2 lacked the desired efficacy.

EXAMPLE 3

This example illustrated the efficacy of a fuel additive composition comprised of 2 dry ounces of sodium chloride, 2 dry ounces iron oxide, 2 dry ounces zinc oxide and 2 dry ounces magnesium oxide, dispersed in kerosene for a total volume of 2 gallons. The product was filtered to remove any particles not dispersed in the liquid. The filtering process could have resulted in the removal of as much as 50% of the solute. However, the solute components were presumably removed in proportional amounts.

Example 3 was conducted using the same protocol as Examples 1 and 2 and produced similar results. Those vehicles driven 25 to 50 miles with the additive showed a fair improvement in emissions reduction, while those driven 50 or more miles showed excellent improvement. However, the results of the test as a whole were categorized as fair. Specifically, the vehicles involved in Example 3 experienced an average decrease in hydrocarbon emissions of 35%, an average decrease in carbon monoxide emissions of 30% and average decrease in molecular oxygen emissions of 10%. The vehicles also experienced an undesirable average decrease in carbon dioxide emissions of 15%.

The vehicles involved in Example 3 tended to show more consistent fuel ignition with use of the additive, as well as increased power. Though the short term test results indicated a lowering of molecular oxygen and carbon dioxide, that effect tended to be reversed after the car was driven approximately 100 or more miles.

Though hydrocarbon and carbon dioxide showed marked improvement almost immediately, improvement in oxygen and carbon monoxide was slower. This phenomenon would seem to indicate that carbon deposits were probably being removed too rapidly for the emission system to handle. This was true for vehicles with and without catalytic converters. However, it was more evident in vehicles with computerized emission controls. All of the vehicles tested showed marked improvement after approximately 200 miles.

EXAMPLE 4

This example illustrated the efficacy of a fuel additive comprised of 2 dry ounces sodium sulfate, 4 dry ounces zinc oxide and 2 dry ounces naphthalene, dispersed in kerosene for a total volume of 2 gallons. Adding naphthalene to the composition likely lowered the flash point to 110° F. The product was filtered to remove any particles not dispersed in the liquid. the filtering process could have resulted in the removal of as much as 50% of the solute. However, the solute components were presumably removed in proportional amounts. Example 4 was conducted using the same protocol as Example 1.

On the whole, the test results were fair, showing less improvement in removal of hydrocarbons than the previous tests, but better results in removing molecular oxygen and carbon dioxide. Those vehicles driven 25 to 50 miles with the additive showed a fair improvement in emissions reduction, as did those driven 50 or more miles. Specifically, the vehicles tested in Example 4 showed an average decrease in hydrocarbon emissions of 20%, an average decrease in carbon monoxide emissions of 20%, and an average decrease in molecular oxygen emissions of 25%. Improvement in acceleration was also observed. However, no change in carbon dioxide emissions was reported.

EXAMPLE 5

Example 5 illustrated the efficacy of a fuel additive comprised of 2 dry ounces of iron oxide, 2 dry ounces of naphthalene flakes, 2 dry ounces of zinc oxide, and 2 dry ounces of zinc acetate, dispersed in kerosene for a total volume of 2 gallons. The product was filtered to remove any particles not dispersed in the liquid. The filtering process could have resulted in the removal of as much as 50% of the solute. However, the solute components were presumably removed in proportional amounts. Example 5 was conducted using the same protocol as Example 1.

On the whole, the results of Example 5 were fair, and showed little improvement over Example 4. Those vehicles driven from 25 to 50 miles with the additive showed a fair improvement in emissions reduction, as did those driven 50 or more miles. Specifically, the results showed an average decrease in hydrocarbon emissions of 35%, an average decrease in carbon monoxide emissions of 20%, and an average decrease in molecular oxygen emissions of 20%. No change in carbon dioxide emissions was reported.

EXAMPLE 6

Example 6 illustrated the efficacy of a fuel additive comprised of approximately 2.67 dry ounces each of magnesium oxide, iron oxide, and zinc oxide, dispersed in kerosene for a total volume of 2 gallons. The product was filtered to remove any particles not dispersed in the liquid. The filtering process could have resulted in the removal of as much as 50% of the solute. However, the solute components were presumably removed in proportional amounts. Example 6 was conducted using the same protocol as Example 1.

The composition of Example 6 showed a noticeable improvement over the compositions tested in the previous five examples. Those vehicles driven 25 to 50 miles with the additive showed good improvement in emissions reduction, while those driven 50 or more miles with the additive showed excellent improvement. Specifically, the vehicles involved in Example 6 experienced an average decrease in hydrocarbon emissions of at least 60%, an average decrease in carbon monoxide emissions of at least 60%, an average decrease in molecular oxygen emissions of at least 10%. Though the vehicles also showed an undesirable average decrease in carbon dioxide emissions of at least 10%, the results, on the whole, were categorized as excellent.

Performance of the vehicles using the additive composition of Example 6 was much better than performance using the compositions tested in any of the preceding examples. Based on the results obtained in Example 6, it was determined that a fuel additive composition comprised of a mixture of magnesium oxide, iron oxide and zinc oxide in weight ratios of about 1:1:1 is desirable.

EXAMPLE 7

Example 7 illustrated the efficacy of a fuel additive comprised of 2 ounces activated carbon, 2 ounces iron oxide, and 4 ounces naphthalene and dispersed in kerosene for a total volume of 2 gallons. The product was filtered to remove any particles not dispersed in the liquid. The filtering process could have resulted in the removal of as much as 50% of the solute. However, the solute components were presumably removed in proportional amounts. Example 7 was conducted using the same protocol as Example 1.

The results were poor, showing a real improvement over previous examples only in the level of carbon dioxide emissions. Specifically, vehicles driven with the Example 7 additive showed an average increase in carbon dioxide emissions of 20%. However, the average decrease in carbon monoxide emissions was only 10%, and no change whatsoever was noted in hydrocarbon or molecular oxygen emissions. Accordingly, the composition of Example 7 lacked the desired efficacy.

EXAMPLE 8

Example 8 illustrated the efficacy of a fuel additive comprised of 2 dry ounces naphthalene, 4 dry ounces zinc oxide, 1 dry ounce iron oxide, and 1 dry ounce magnesium oxide, dispersed in a carrier solution of 50% kerosene and 50% alcohol for a total volume of 2 gallons. The product was filtered to remove any particles not dispersed in the liquid. The filtering process could have resulted in the removal of as much as 50% of the solute. However, the solute components were presumably removed in proportional amounts. Example 8 was conducted using the same protocol as Example 1.

Vehicles driven with the Example 8 additive experienced excellent results, both when driven between 25 and 50 miles, and when driven 50 or more miles. Specifically, hydrocarbon emissions decreased an average of at least 60%, carbon monoxide emissions decreased an average of at least 60%, molecular oxygen emissions decreased an average of at least 60%, and carbon dioxide emissions increased an average of 20%. The increase in the amount of carbon dioxide emissions likely indicates that the additive cleaned the spark plugs much faster than the compositions previously tested. Drivers involved in the test reported much improved engine performance and increase mileage using the additive.

Based on the results obtained in example 8, it was determined that about 1:2 is a desirable weight ratio of naphthalene to zinc oxide. Additionally, the test results indicated that about 3:1 is a desirable weight ratio of the composite of zinc oxide and napthalene to the composite of iron oxide and magnesium oxide.

EXAMPLE 9

Example 9 illustrated the efficacy of a fuel additive comprised of 2 ounces naphthalene, 4.8 ounces zinc oxide, 0.4 ounces iron oxide and 0.8 ounces magnesium oxide, dispersed in alcohol for a total volume of 2 gallons. The product was filtered to remove any particles not dispersed in the liquid. The filtering process could have resulted in the removal of as much as 50% of the solute. However, the solute components were presumably removed in proportional amounts. Example 9 was conducted using the same protocol as Example 1.

The results obtained were excellent, both from vehicles driven 25 to 50 miles with the additive and those driven 50 or more miles with the additive. Specifically, the vehicles experienced an average decrease in hydrocarbon emissions of at least 70%, an average decrease in carbon monoxide emissions of at least 70%, an average decrease in molecular oxygen emissions of at least 70%, and an average increase in carbon dioxide emissions of 50%.

Apparently, the greater the alcohol content of the carrier liquid, the greater the increase in carbon dioxide emissions and the decrease in molecular oxygen emissions. As such, oxygenates appear to be vital to the attainment of good results from oxygen and carbon dioxide levels. However, oxygenates are not as vital to overall engine performance if the fuel additive is added at shorter intervals in a less concentrated form.

Based on the results observed in Example 9, it was determined that about 1:2.5 is a desirable weight ratio of naphthalene to zinc oxide. Additionally, the test results indicated that about 6:1 is a desirable weight ratio of the composite of zinc oxide and napthalene to the composite of iron oxide and magnesium oxide.

EXAMPLE 10

Experiment 10 illustrated the efficacy of the fuel additive composition of Example 9 dispersed in diesel, instead of alcohol, for a total volume of 2 gallons. The product was filtered to remove any particles not dispersed in the liquid. The filtering process could have resulted in the removal of as much as 50% of the solute. However, the solute components were presumably removed in proportional amounts. Example 10 was conducted using the same protocol as Examples 1 and 9.

On the whole, the results of Example 10 were categorized as excellent. Those vehicles driven 25 to 50 miles with the additive showed good results, while those driven 50 or more miles showed excellent results. Specifically, the vehicles tested experienced an average decrease in hydrocarbon emissions of at least 60%, an average decrease in carbon monoxide emissions of at least 60%, and an average decrease in molecular oxygen emissions of at least 60%. However, the vehicles also exhibited an undesirable 10% average decrease in carbon dioxide emissions.

Based on the results observed in Example 10, it was determined that alcohol is slightly preferable to diesel as a carrier liquid.

EXAMPLE 11

Example 11 illustrated the efficacy of a fuel additive comprised of 2.50 pounds naphthalene, 2.00 pounds zinc oxide, 0.08 pounds iron oxide, and 0.08 pounds magnesium oxide, dispersed in methanol for a total volume of 100 gallons of finished product. The product was filtered to remove any particles not dispersed in the liquid.

The filtering process could have resulted in the removal of as much as 50% of the solute. However, the solute components were presumably removed in proportional amounts. Example 11 was conducted using the same protocol as Example 1, except that the filtered product was dispersed in fuel at the rate of 6, instead of 8, fluid ounces of the filtered fuel additive composition per 15 gallons of fuel. The results obtained using the composition of Example 11 were excellent.

Based on the results observed in Example 11, it was determined that a weight ratio of naphthalene to zinc oxide no greater than about 4:3 is desired; preferably, the ratio is about 5:4. The results further indicated that a desirable weight ratio of the composite of zinc oxide and naphthalene to the composite of iron oxide and magnesium oxide is about 30:1.

EXAMPLE 12

Experiment 12 illustrated the efficacy of the fuel additive composition of Example 11 dispersed in a carrier solution comprised of approximately 80 wt. % methanol and 20 wt. % kerosene, instead of 100 wt. % methanol, for a total volume of 100 gallons of finished product. The product was filtered to remove any particles not dispersed in the liquid. The filtering process could have resulted in the removal of as much as 50% of the solute. However, the solute components were presumably removed in proportional amounts. Example 12 was conducted using the same protocol as Example 1, except that the filtered fuel additive was dispersed in fuel at the rate of 6, instead of 8, fluid ounces per 15 gallons of fuel.

The results obtained using the composition of Example 12 were excellent. Based on the results observed in Example 12, it was determined that a weight ratio of naphthalene to zinc oxide no greater than about 4:3 is desired; preferably, the ratio is about 5:4. The results further indicated that a desirable weight ratio of the composite of zinc oxide and naphthalene to the composite of iron oxide and magnesium oxide is about 30:1. The results also indicated that a carrier liquid comprised of about 80 wt % methanol and about 20 wt % kerosene is desirable.

While the present invention has been described in detail and with reference to specific examples, it will be apparent to one skilled in the art that various changes and modifications can be made therein without departing from the spirit and the scope of the invention.

What is claimed is:

1. In a fuel additive for a hydrocarbon fuel, the composition comprising a) at least 90 wt. % of a carrier liquid selected from the group consisting of a hydrocarbon fraction in the kerosene boiling range having a flash point of at least 100° F. and an auto-ignition temperature of at least 400° F., a $C_1$–$C_3$ monohydric, dihydric or polyhydric aliphatic alcohol, and mixtures thereof;

b) a bicyclic aromatic component selected from the group consisting of naphthalene, substituted naphthalene, biphenyl, biphenyl derivatives, and mixtures thereof;

c) zinc oxide;

d) one or more Group 8-11 metal oxides selected from the group consisting of iron oxide, copper oxide, cobalt oxide, ruthenium oxide, osmium oxide, and palladium oxide, said one or more metal oxides being present in an amount less than the amount of said zinc oxide.

2. The composition of claim 1 further comprising magnesium oxide present in an amount less than said zinc oxide.

3. The composition of claim 2, wherein said magnesium oxide and said Group 8-11 metal oxide are present in a composite amount which is less than said bicyclic aromatic component.

4. The composition of claim 3, wherein said aliphatic alcohol is selected from the group consisting of methanol, ethanol and isopropyl alcohol.

5. The composition of claim 4, wherein said aliphatic alcohol comprises at least 50 wt. % of said carrier liquid.

6. The composition of claim 5, wherein said aliphatic alcohol comprises at least 80 wt. % of said carrier liquid, and said kerosene comprises no more than 20 wt. % of said carrier liquid.

7. The composition of claim 6, wherein said kerosene comprises from about 5 wt. % to about 20 wt. % of said carrier liquid.

8. The composition of claim 4, wherein said aliphatic alcohol is methanol.

9. The composition of claim 8, wherein said methanol comprises at least 50 wt. % of said carrier liquid.

10. The composition of claim 9, wherein said methanol comprises at least 80 wt. % of said carrier liquid, and said kerosene comprises no more than 20% of said carrier liquid.

11. The composition of claim 10, wherein said kerosene comprises from about 5 wt. % to about 20 wt. % of said carrier liquid.

12. The composition of claim 3, wherein the weight ratio of said aromatic component to said zinc oxide is within the range of about 4:3 to about 1:3.

13. The composition of claim 12, wherein the weight ratio of said bicyclic aromatic component to said zinc oxide is about 5:4.

14. The composition of claim 3, wherein said bicyclic aromatic component is naphthalene.

15. The composition of claim 14, wherein the weight ratio of said naphthalene to said zinc oxide is within the range of about 4:3 to about 1:3.

16. The composition of claim 15, wherein the weight ratio of said naphthalene to said zinc oxide is about 5:4.

17. The composition of claim 14, wherein said Group 8-11 metal oxide is iron oxide.

18. The composition of claim 17, wherein the weight ratio of the composite of said zinc oxide and said naphthalene to the composite of said iron oxide and said magnesium oxide is at least about 3:1.

19. The composition of claim 18, wherein the weight ratio of the composite of said zinc oxide and said naphthalene to the composite of said iron oxide and said magnesium oxide is about 30:1.

20. The composition of claim 18, wherein said aliphatic alcohol is selected from the group consisting of methanol, ethanol and isopropyl alcohol.

21. The composition of claim 20, wherein said aliphatic alcohol comprises at least 50 wt. % of said carrier liquid.

22. The composition of claim 21, wherein said aliphatic alcohol comprises at least 80 wt. % of said carrier liquid, and said kerosene comprises no more than 20 wt. % of said carrier liquid.

23. The composition of claim 22, wherein said kerosene comprises from about 5 wt. % to about 20 wt. % of said carrier liquid.

24. The composition of claim 20, wherein said aliphatic alcohol is methanol.

25. The composition of claim 24, wherein said methanol comprises at least 50 wt. % of said carrier liquid.

26. The composition of claim 25, wherein said methanol comprises at least 80 wt. % of said carrier liquid, and said kerosene comprises no more than 20 wt. % of said carrier liquid.

27. The composition of claim 26, wherein said kerosene comprises from about 5 wt. % to about 20 wt. % of said carrier liquid.

28. In a fuel additive for a hydrocarbon fuel, the composition comprising:

a) at least 90 wt. % of a carrier liquid selected from the group consisting of a hydrocarbon fraction in the kerosene boiling range having a flash point of at least 100° F. and an auto-ignition temperature of at least 400° F., a $C_1$–$C_3$ monohydric, dihydric or polyhydric aliphatic alcohol, and mixtures thereof; and b) no more than 10 wt. % of a mixture of magnesium oxide, iron oxide and zinc oxide in weight ratios of about 1:1:1.

29. In a process for formulating a fuel blend for use in fueling an internal combustion engine, the steps comprising:

a) providing a hydrocarbon containing fuel for said internal combustion engine;

b) adding to said hydrocarbon containing fuel a fuel extending additive comprising:

1) a bicyclic aromatic component selected from the group consisting of naphthalene, substituted naphthalene, biphenyl, biphenyl derivatives, and mixtures thereof;

2) zinc oxide;

3) one or more Group 8-11 metal oxides selected from the group consisting of iron oxide, copper oxide, cobalt oxide, ruthenium oxide, osmium oxide, and palladium oxide, said one or more metal oxides being present in an amount less than the amount of said zinc oxide.

30. The process of claim 29, wherein said fuel extending additive further comprises magnesium oxide present in an amount less than the amount of said zinc oxide.

31. The process of claim 30, further comprising the step of adding said fuel extending additive to said hydrocarbon-containing fuel in an amount to provide a decrease in emissions from the exhaust system of at least 50% each in hydrocarbon and carbon monoxide emissions when compared with the emissions in said hydrocarbon fluid without the inclusion of said additive.

32. The process of claim 31, wherein said additive is added in an amount to provide a decrease in molecular oxygen emissions from said exhaust system of at least 10% when compared with the corresponding emissions from said exhaust system without the inclusion of said additive.

33. The process of claim 31, wherein said additive composition is mixed with said hydrocarbon fuel in a ratio of hydrocarbon fuel to additive composition of at least about 300:1.

34. The process of claim 31, wherein said additive composition is mixed with said hydrocarbon fuel in a ratio of hydrocarbon fuel to additive composition of at least about 600:1.

35. The process of claim 30, further comprising the step of adding said fuel extending additive to said hydrocarbon-containing fuel in an amount to provide a decrease of at least 10% in the amount of said hydrocarbon-containing fuel consumed by said internal combustion engine as compared with the corresponding amount of said hydrocarbon-containing fuel consumed by said internal combustion engine without the inclusion of said additive.

36. In the operation of an internal combustion engine having associated therewith a fuel chamber from which fuel is supplied to said engine and an exhaust system for the emission of combustion products from said engine, the process comprising:

a) providing in said fuel chamber a hydrocarbon-containing fuel suitable for use in said internal combustion engine; and b) providing in said fuel chamber a fuel extending additive in a mixture with said hydrocarbon-containing fuel, said fuel extending additive comprising a mixture of magnesium oxide, zinc oxide and iron oxide in relative amounts to provide a decrease in emissions from the exhaust system of said internal combustion engine of at least 50% each in hydrocarbon and carbon monoxide emissions and a decrease of at least 10% in molecular oxygen emissions when compared with the corresponding emissions from said exhaust system of a base condition involving the use of said hydrocarbon fuel without the inclusion of said fuel extending additive.

37. The process of claim 36, wherein said fuel extending additive further comprises a bicyclic aromatic component selected from the group consisting of naphthalene, substituted, biphenyl, biphenyl derivatives, and mixtures thereof.

38. The process of claim 37, wherein the weight ratio of the composite of said bicyclic aromatic component and said zinc oxide component to the composite of said iron oxide and magnesium oxide is at least about 3:1.

39. The process of claim 38, wherein said weight ratio is at least about 30:1.

40. The process of claim 36, wherein said hydrocarbon fuel and said fuel extending additive are supplied separately to said fuel chamber.

41. The process of claim 36, wherein said metal oxides are supplied to said fuel chamber in a carrier liquid selected from the group consisting of a hydrocarbon fraction in the kerosene boiling range and a $C_1$–$C_3$ monohydric, dihydric or polyhydric aliphatic alcohol, and mixtures thereof.

42. The process of claim 41, wherein said fuel extending additive further comprises a bicyclic aromatic component selected from the group consisting of naphthalene, substituted naphthalene, biphenyl, biphenyl derivatives, and mixtures thereof.

43. The process of claim 42, wherein the weight ratio of the composite of said bicyclic aromatic component and said zinc oxide component to the composite of said iron oxide and said magnesium oxide is at least about 3:1.

44. In the operation of an internal combustion engine having associated therewith a fuel chamber from which fuel is supplied to said engine and an exhaust system for the emission of combustion products from said engine, the process comprising:

a) providing in said fuel chamber a hydrocarbon containing fuel suitable for use in said internal combustion engine; and b) providing in said fuel chamber a fuel extending additive in a mixture with said hydrocarbon containing fuel, said fuel extending additive comprising a mixture of a bicyclic aromatic component selected from the group consisting of naphthalene, substituted naphthalene, biphenyl, biphenyl derivatives, and mixtures thereof, and a mixture of magnesium oxide, zinc oxide and iron oxide in relative amounts to provide a decrease in emissions from the exhaust system of said internal combustion engine of at least 50% each in hydrocarbon and carbon monoxide emissions and at least 10% decrease in molecular oxygen emissions when compared with the corresponding emissions from said exhaust system of a base condition involving the use of said hydrocarbon fuel without the inclusion of said fuel extending additive.

45. The process of claim 44, wherein the weight ratio of the composite of said bicyclic aromatic component and said zinc oxide component to the composite of said iron oxide and magnesium oxide is at least about 3:1.

46. The process of claim 45, wherein said weight ratio is at least about 30:1.

47. The process of claim 44, wherein said hydrocarbon fuel and said fuel extending additive are supplied separately to said fuel chamber.

48. The process of claim 44, wherein said metal oxides are supplied to said fuel chamber in a carrier liquid selected from the group consisting of a hydrocarbon fraction in the kerosene boiling range and a $C_1$–$C_3$ monohydric, dihydric or polyhydric aliphatic alcohol, and mixtures thereof.

49. The process of claim 48, wherein the weight ratio of the composite of said bicyclic aromatic component and said zinc oxide component to the composite of said iron oxide and said magnesium oxide is at least about 3:1.

* * * * *